United States Patent [19]

Vazquez

[11] 4,398,600

[45] Aug. 16, 1983

[54] SYSTEMS FOR LANDING WIRE LINE TOOLS AT SELECTED LEVELS WITHIN A WELL TUBING STRING

[75] Inventor: Gonzalo Vazquez, Houston, Tex.

[73] Assignee: Ava International Corporation, Houston, Tex.

[21] Appl. No.: 212,856

[22] Filed: Dec. 4, 1980

[51] Int. Cl.[3] ..... E21B 23/02

[52] U.S. Cl. ..... 166/206; 166/242; 166/243

[58] Field of Search ..... 166/86, 88, 113, 115, 166/156, 206, 217, 242, 243, 381, 382, 383, 378, 237, 75 A, 75 R

[56] References Cited

U.S. PATENT DOCUMENTS

| | | | |
|---|---|---|---|
| 3,263,752 | 8/1966 | Conrad | 166/237 |
| 3,273,646 | 9/1966 | Walker | 166/86 |
| 3,357,486 | 12/1967 | Brown | 166/88 |

*Primary Examiner*—Stephen J. Novosad
*Assistant Examiner*—Joseph Falk
*Attorney, Agent, or Firm*—Vaden, Eickenroht, Thompson, Bednar & Jamison

[57] ABSTRACT

There is disclosed, for use in a system for landing wire line "no go" tools at selected levels within a tubing string, a landing nipple connectible in the tubing string and in which either a top or a bottom "no go" tool may be landed.

2 Claims, 3 Drawing Figures

IMPROVEMENTS IN SYSTEMS FOR LANDING WIRE LINE TOOLS AT SELECTED LEVELS WITHIN A WELL TUBING STRING

This invention relates in general to systems for landing wire line tools at selected levels within a well tubing string. More particularly, it relates to improvements in systems of this type in which the tools have successively smaller diameter shoulders which are adapted to be landed, respectively, upon successively smaller diameter seats within the bores of landing nipples connected as part of the string at successively lower levels therein.

The landing nipples may be connected as part of the well tubing string at different production levels within the well, whereby a selected tool may be landed in a selected nipple to control flow at a desired production level. Thus, for example, the tools may be plugs to close off the bore of the string, or tools which otherwise control flow through ports in the string connecting with the annulus in the well bore about the string, or combinations thereof. In any event, each tool normally carries a seal thereabout for sealing engagement with a polished section of the bore of the nipple, and a latch adapted to be received within a groove in the bore to prevent displacement of the tool upwardly within the string.

Ordinarily, the nipples are arranged in vertically successive pairs, with the upper nipple of each pair having a seat above and of larger diameter than the polished section of its bore to land a top "no go" tool as a shoulder about the tool is lowered onto the seat, and the lower nipple thereof having a seat below and of lesser diameter than such section to land a bottom "no go" tool as a shoulder about such tool is lowered onto the seat. Thus, the polished sections of the bores of the upper and lower nipples are of the same diameter to receive equal diameter seals about the top and bottom "no go" tools, whereby the only restriction in the bore from the upper nipple of each pair of the lower nipple thereof is that of the seat therein.

Since each "no go" tool of existing systems of this type requires a separate nipple, the operator must carry a large inventory of nipples. It is an object of this invention to substantially reduce the inventory which an operator must maintain for this purpose, and, more particularly, to provide a system having landing nipples in which either a top or bottom "no go" may be landed.

These and other objects are accomplished, in accordance with the illustrated embodiment of the present invention, by a landing nipple of the type described whose bore has a first seat above and of larger diameter than the polished section to receive a top "no go" tool, a groove beneath the polished section, and a ring removably disposable within the groove to provide a second seat of lesser diameter than the polished section to land the bottom "no go" tool. With the ring removed from within the groove, the bottom "no go" tool may be lowered through the nipple bore and into a landed position within the the next lower nipple, such that the upper nipple may be used to land the top "no go" tool. Consequently, the operator is required to carry only one nipple in inventory for use in landing either a top or bottom "no go" tool, depending on his needs. Furthermore, since the seal about each "no go" tool is sealably engageable with the same polished section, the extent to which each must slide over such section is minimized—i.e., the seal about the top "no go" tool need only be moved into a single polished section, and the seal about the bottom "no go" tool need be moved only through the polished section in the landing nipple for the top "no go" tool as it is lowered into the polished section in the next successive lower nipple for landing therein. In this preferred and illustrated embodiment of the invention, the latch recess is provided in the bore above the upper seat.

In the drawings, wherein like reference characters are used throughout to designate like parts:

Figure 1:
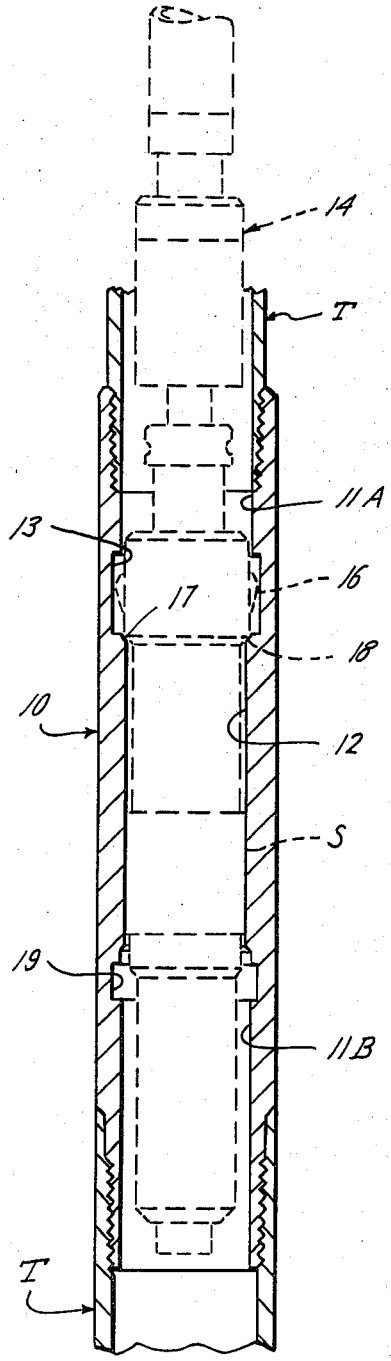
FIG. 1 is a vertical, sectional view of a landing nipple constructed in accordance with the present invention, with the ring removed therefrom and a top "no go" tool (shown in broken lines) landed on an upper seat in the bore.
Figure 2:
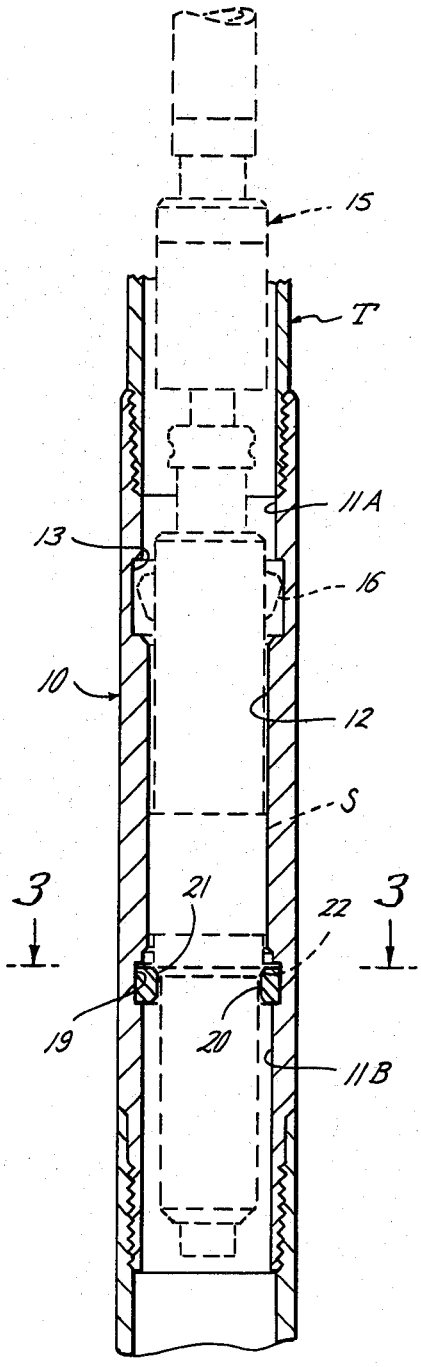
FIG. 2 is a view of the landing nipple, similar to FIG. 1, but with the ring disposed in the groove to provide a lower seat on which a bottom "no go" tool (shown in broken lines) is landed.

With reference now to the details of the abovedescribed drawings, the landing nipple shown in each of FIGS. 1 and 2, and indicated in its entirety by reference character 10, has threads on its upper and lower ends for connection as part of the tubing string T, which, as well known in the art, extends downwardly from the head of a well. As also well known in the art, packers (not shown) close off the annulus between the string and the well bore at one or more levels along the height of the well, usually above an uppermost production zone and intermediate adjacent production zones.

As previously described, in a system of this type for landing wire line tools at selected levels within the tubing string, and thus controlling flow at one or more selected levels therein, a series of landing nipples will be connected as part of the string at such levels. As also previously described, and again as well known in the art, the nipple may be imperforate intermediate its opposite ends, as in the case of the illustrated nipple 10, or may be provided with one or more ports therein for controlling flow between the bore of the nipple and the annulus thereabout.

As shown in FIGS. 1 and 2, a section 12 of the bore through the tubular member is polished to permit it to be sealingly engaged by a seal carried by the "no go" tool landed therein. Also, a recess 13 is formed in an enlarged diameter portion 11A of the bore above the polished section 12 to receive latches on the "no go" tools which prevent such tools from upward displacement within the tubing string when landed in the nipple.

As shown, the top "no go" tool shown in FIG. 1, and indicated by reference character 14, as well as the bottom "no go" tool shown in FIG. 2, and indicated in its entirety by reference character 15, carries a seal S thereabout which, with the tool landed in the nipple, as shown in each of FIGS. 1 and 2, sealably engages the polished bore section 12. Each such tool also carries latches 16 which, with the tool landed in the nipple, is adapted to be received within the recess 13. Each such tool may be otherwise similar to conventional "no go" tools in that its upper end is suitably prepared for connection to a wire line which permits it to be lowered into and raised from landing position, and further in that it has parts which are adapted to be manipulated by means of the wire line to move the latches between expanded and retracted with respect to the recess when the tool is landed in the nipple.

An upper seat 17 is formed in the bore of the landing nipple intermediate the recess 13 and polished section 12 in position to be engaged by a shoulder 18 about the top "no go" tool 14 in order to land the latter in the position shown in FIG. 1. When the top "no go" tool is so landed, its seal S has moved into sealing engagement with polished bore section 12 and its latches 16 are opposite and thus in a position to be expanded into recess.

Figure 3:
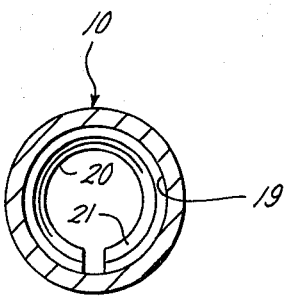
FIG. 3 is a cross-sectional view of the landing nipple, as seen along broken lines 3—3 of FIG. 2.

However, as previously described, and in accordance with the novel aspects of the present invention, nipple 10 may instead be used to land bottom "no go" tool 15, and, for this purpose, a groove 19 is formed in an enlarged diameter portion 11B of the bore beneath the polished section 12 to receive a ring 20 which, when so received, provides a lower seat 21 on which tool 15 may be landed. As best shown in FIG. 3, the ring is of a so-called "C" type which is split upon its circumference to permit it to be circumferentially contracted for movement through bore portion 11B for disposal within or removal from the groove. More particularly, the inner diameter of the ring is smaller than the diameter of the polished section 12 so that a seat 21 on its upper end is in position to be engaged by a landing shoulder 22 on the bottom "no go" tool 15 in order to land such tool in the position of FIG. 2. When so landed, the seal S about the bottom "no go" tool has moved into sealing engagement with polished bore section 12, and latches 16 thereon are opposite recess 13 so that they may be moved into and out of latching position thereon.

Thus, as previously described, the landing nipple 11 is selectively usable for landing either the top "no go" tool 14 or the bottom "no go" tool 15 in the positions shown. In the event it is to be used to land the top "no go" tool 14, seat ring 20 is removed from within its bore so that a bottom "no go" tool, such as the tool 15, may be lowered through its polished bore section 12 into landed position within a nipple connected in the string T beneath nipple 10. On the other hand, if it is to be used to land the bottom "no go" tool, the seat ring is installed within the groove and thus in a position to be engaged by the shoulder 22 on the tool.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. For use in a system in which wire line tools are adapted to be landed at selected levels within a well tubing string, an assembly comprising first and second wire line tools both having seals thereabout of equal diameter and latches for latching the tool in landed position within said string, said first tool having a shoulder above and of larger diameter than its seal, said second tool having a shoulder below and of lesser diameter than its seal, a nipple connectible as part of a well tubing string and having a bore therethrough in which either of said first and second tools may be landed, said bore having a polished section with which the seal about whichever tool is landed therein is sealably engageable, a first seat in the bore above and of larger diameter than the polished section to land said first tool when the shoulder thereof is lowered into engagement therewith, a groove in the bore beneath the polished section, a ring releasably disposable within the groove to provide a second seat of smaller diameter than said polished section to land said second tool when the shoulder thereof is lowered into engagement therewith, and a recess in the bore to receive a latch on whichever tool which is landed therein.

2. An assembly of the character defined in claim 1, wherein the recess is above the upper seat.

* * * * *